US006655816B2

(12) United States Patent
Wu

(10) Patent No.: US 6,655,816 B2
(45) Date of Patent: Dec. 2, 2003

(54) DO-IT-YOURSELF LAMP

(76) Inventor: Wen-Chang Wu, Taipei (TW)

( * ) Notice: Subject to any disclaimer, the term of this patent is extended or adjusted under 35 U.S.C. 154(b) by 0 days.

(21) Appl. No.: 10/127,149

(22) Filed: Apr. 22, 2002

(65) Prior Publication Data

US 2003/0198043 A1 Oct. 23, 2003

(51) Int. Cl.[7] ..... H01R 33/00
(52) U.S. Cl. ..... 362/226; 362/410
(58) Field of Search ..... 362/147, 226, 362/404, 410, 411, 412, 413, 414, 432, 405, 406

(56) References Cited

U.S. PATENT DOCUMENTS 1,623,813 A * 4/1927 Schell ..... 362/404
5,873,652 A * 2/1999 Bayer et al. ..... 362/404
6,113,250 A * 9/2000 Lin ..... 362/413

* cited by examiner

*Primary Examiner*—Y. My Quach-Lee

(57) ABSTRACT

A do-it-yourself lamp comprises a seat, and a lamp rod arranged on the seat. The seat has a plurality of penetrated stepped holes and a positioning disk having a plurality of through holes. A receptacle passes through one of the through holes. A plurality of locking holes are arranged between the through holes. A bottom of the lamp rod is inserted with a joint and one end portion of the joint is slightly protruded from the bottom end of the lamp rod. After inserting the lamp rod, the end portion of the joint is exactly inserted into the receptacle. In packaging, transferring, or storage, the lamp rod and seat can be separated for reducing the space. It is only necessary to insert the lamp rod into the seat for use. Thereby, users can assembled the lamp rod and seat by himself (or herself).

6 Claims, 5 Drawing Sheets

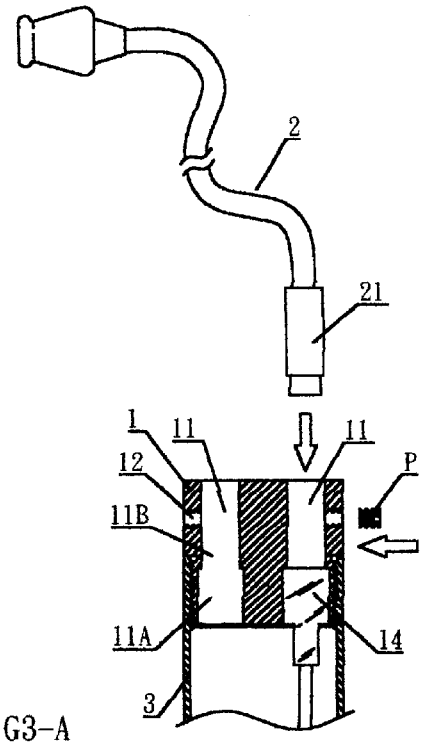
FIG3-A
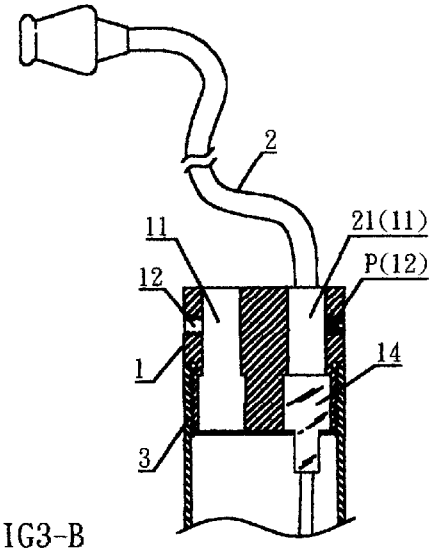
FIG3-B

DO-IT-YOURSELF LAMP

FIELD OF THE INVENTION

The present invention relates to lamp devices, and particularly to a do-it-yourself lamp, wherein in packaging, transferring, or storage, the lamp rod and seat can be separated for reducing the space required. Since the seat is assembled to a retaining tube of the seat, when the user buys the lamp, it is only necessary to insert the lamp rod into the seat for use. No other locking tool is necessary. Thereby, users can assembled the lamp rod and seat by himself (or herself).

BACKGROUND OF THE INVENTION

For prior art lamps, such as wall lamps, stand lamps, or ceiling lamps, the studs and nuts are used as locking tools. However, in such prior art locking method, the lamps are not only easily damaged, but also locking tools (such as spanners, or openers) are necessary in locking operation. In assembly, the electric wires are easily protruded out due to friction. Thereby, people easily get an electric shock. The prior art structure is not suitable to be assembled by users himself (or herself). The manufacturers must assembly the lamps in advance for sale. However, this will increase the space in transformation and storage and thus the cost is increased.

SUMMARY OF THE INVENTION

Accordingly, the primary object of the present invention is to provide a do-it-yourself lamp which can improve the defects of the prior art, and the user can assemble the lamp structure by himself (or herself).

To achieve above objects, the present invention provides a do-it-yourself lamp comprises a seat, and a lamp rod arranged on the seat. The seat has a plurality of penetrated stepped holes and a positioning disk. The positioning disk has a plurality of through holes aligned to the stepped holes but having a smaller diameter. A receptacle passes through one of the through holes. A plurality of locking holes are arranged between the through holes. Thereby, a locking stud passes through a ground wire and then passes through the locking hole of the positioning disk. Then, it is locked to a lower end of the seat. After the positioning disk is locked, a bottom of the lamp rod is inserted with a joint in advance and one end portion of the joint is slightly protruded from the bottom end of the lamp rod. After inserting the lamp rod, the end portion of the joint slightly protruding from the bottom of the lamp rod is exactly inserted into the receptacle of the seat.

Thereby, in packaging, transferring, or storage, the lamp rod and seat can be separated for reducing the space required. Since the seat is assembled to a retaining tube of the seat, when the user buys the seat, it is only necessary to insert the lamp rod into the seat for use. No other locking tool is necessary. Thereby, users can assembled the lamp rod and seat by himself (or herself).

The various objects and advantages of the present invention will be more readily understood from the following detailed description when read in conjunction with the appended drawing.

BRIEF DESCRIPTION OF THE DRAWINGS

FIG. 3A is a plane cross sectional view of the present invention before insertion.

FIG. 3B is a plane cross sectional view of the present invention after insertion.

DETAILED DESCRIPTION OF THE PREFERRED EMBODIMENTS

Figure 1:
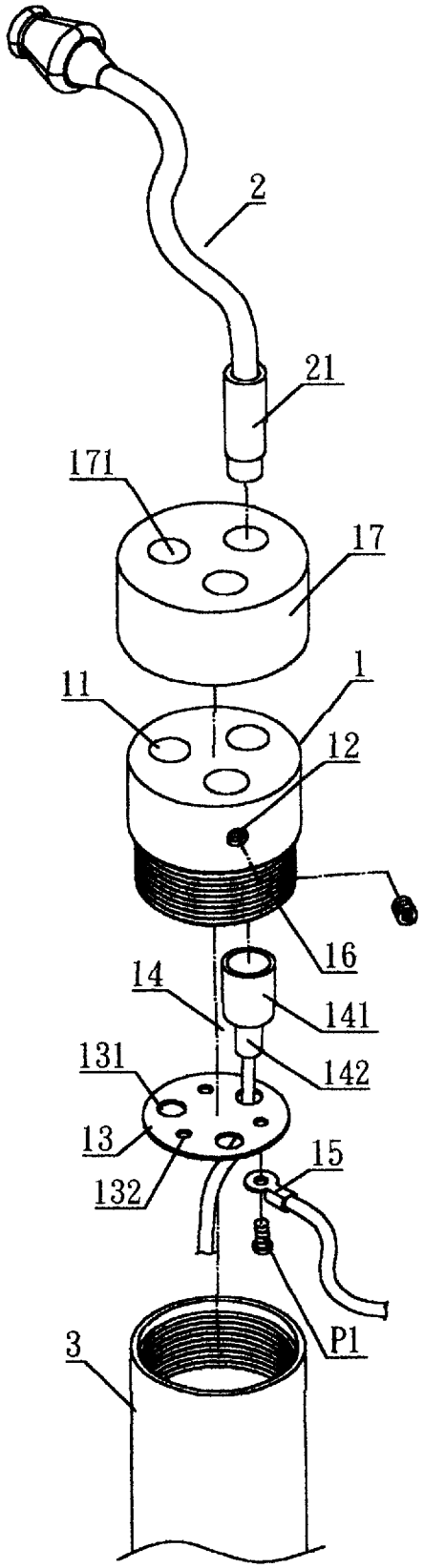
FIG. 1 is an exploded perspective view of the present invention.
Figure 2:
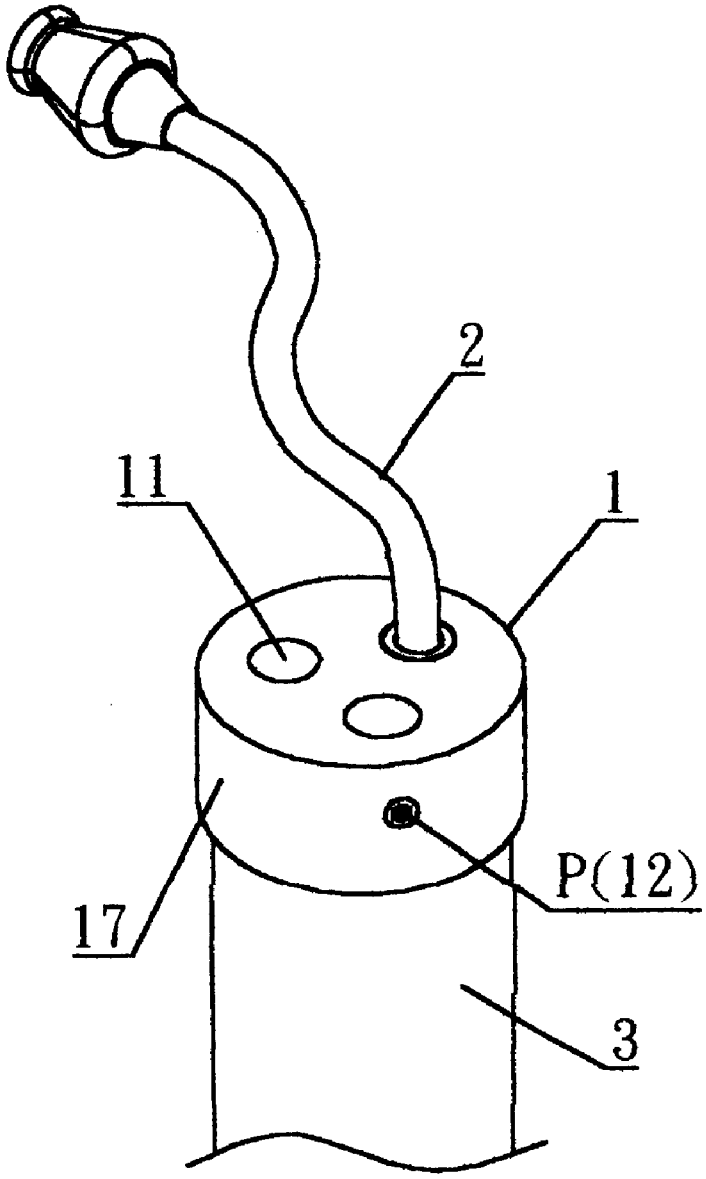
FIG. 2 is an assembled perspective view of the present invention.

Referring to FIG. 2, the structure of the do-it-yourself lamp of the present invention is illustrated. The do-it-yourself lamp of the present invention includes a seat 1, and a lamp rod 2 arranged on the seat 1.

The interior of the seat 1 has a plurality of penetrated stepped holes 11. A large stepped hole 11A of each stepped hole 11 is exactly inserted by a receptacle 14, and the small stepped hole 11B is exactly inserted by the joint 21 of the lamp rod 2. At a side surface of the seat 1 has a plurality of threaded holes 12 for tightening a confining stud P as the confining stud P is locked in the stepped holes.

A cap 17 is installed upon a top surface of the seat 1, and the cap 17 has a via hole 171 which is aligned to stepped holes 11 of the seat 1. A lower end of the seat 1 is locked with a positioning disk 13 by a lock stud P1. The positioning disk 13 has a plurality of through holes 131 aligned to the stepped holes 11 but having a smaller diameter. The receptacle 14 can pass through one of the through holes 131. A plurality of locking holes 132 are arranged between the through holes 131. Thereby, the locking stud P1 can pass through a ground wire 15 and then passes through the locking hole 132 of the positioning disk 13. Then, it is locked to a lower end of the seat 1.

After the positioning disk 13 is locked, the edge of the receptacle 14 exactly resists against the positioning disk 13 for preventing the plug from falling out. The larger section 141 of the receptacle 14 is exactly positioned in the stepped holes 11 of the seat 1 and the smaller section 142 thereof is protruded from the lower end of the positioning disk 13. The bottom of the seat 1 is installed with an outer threaded section 16. After the seat 1 is assembled with the positioning disk 13, the receptacle 14 and the ground wire 15, the outer threaded section 16 of the seat 1 can be locked into the retaining tube 3 of a wall lamp, stand lamp or a ceiling lamp.

The bottom of the lamp rod 2 is inserted with a joint 21 in advance and one end portion of the joint 21 is slightly protruded from the bottom of the lamp rod 2. After inserting the lamp rod 2, the end portion of the joint 21 slightly protruded from the bottom end of the lamp rod 2 is exactly inserted into the receptacle 14 of the seat 1.

The operation of the present invention will be described herein with referring to FIG. 3. The positioning disk 13 is locked to a lower end of the seat 1 in advance, and the stepped holes in the seat 1 is positioned with a joint 21 in advance. When the lamp rod 2 inserts into the seat 1, the plug 22 at a bottom of the lamp rod 2 is exactly inserted into the receptacle 14 of the seat 1.

Figure 4:
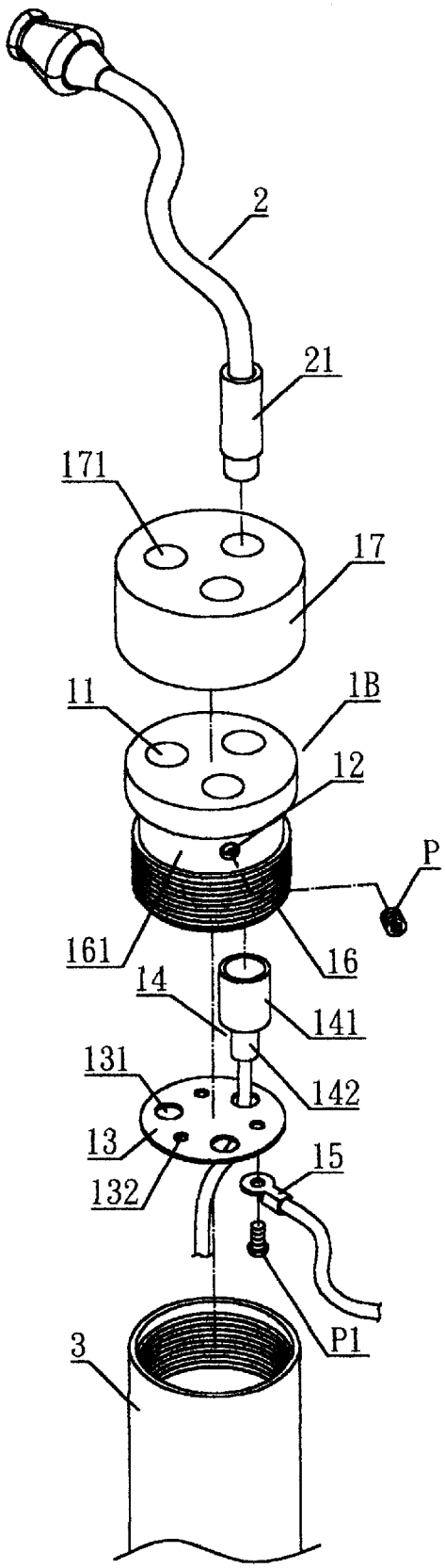
FIG. 4 shows another embodiment of the present invention.
Figure 5:
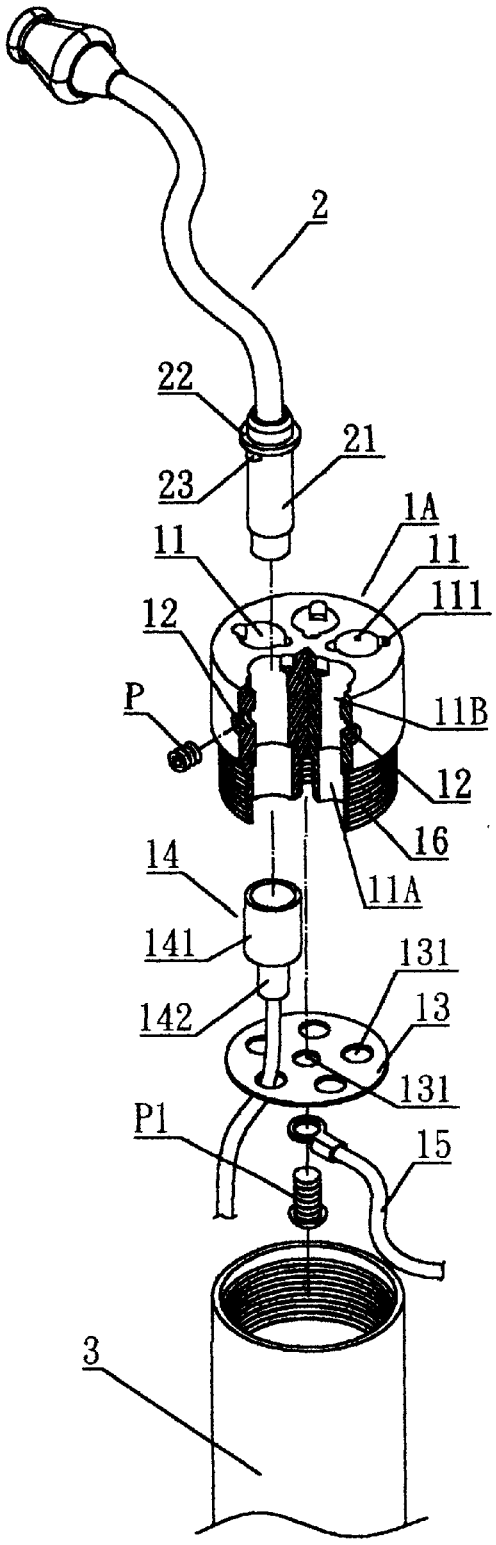
FIG. 5 shows a further embodiment of the present invention.

Referring to FIGS. 4 and 5, another two embodiments of the present invention are illustrated. The seat 1A has penetrated stepped holes 11. Each hole 11 has confining grooves 111 at two sides thereof. Thereby, the receptacle 14 is exactly inserted into the large stepped hole 11A of the seat 1. A lower end of the seat 1 is locked with a positioning disk 13 by a lock stud P1. The positioning disk 13 has a plurality of through holes 131 at the center thereof and at positions aligned to the stepped holes 11. The locking stud P1 passes through a ground wire 15 and then passes through the through hole 131 at the center of the positioning disk 13. Then, it is locked to a lower end of the seat 1.

The lamp rod 2 has a ring 22 conformed to the stepped holes 11 of the seat 1 and has a resisting block 23 conformed to the confining grooves 111. After lamp rod 2 inserts into, the seat 1, the resisting block 23 exactly embeds to the confining groove 111 of the seat 1 for preventing the lamp rod 2 from rotation. The ring 22 of the lamp rod 2 exactly resists against a top end of the seat 1 for resisting against the lamp rod 2 from falling out (referring to FIG. 5).

A top of the outer threaded section 16 of the seat 1 has a neck portion 161. At a portion of the neck portion 161 exactly aligned an edge of the stepped holes 11 has a threaded hole 12. Thereby, the confining stud P may be locked to tighten the joint 21 (referring to FIG. 4).

Thereby, in packaging, transferring, or storage, the lamp rod 2 and seat 1 can be separated for reducing the space required. Since the seat 1 is assembled to a retaining tube of the seat 1, when the user buys the seat 1, it is only necessary to insert the lamp rod 2 into the seat 1 for use. No other locking tool is necessary. Thereby, users can assembled the lamp rod 2 and seat 1 by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A do-it-yourself lamp comprising a seat and a lamp rod arranged on the seat; a plurality of penetrated stepped holes formed in an interior of the seat; each of the stepped holes having a large stepped hole and a small stepped hole, one end portion of a joint protruded from a bottom end of the lamp rod; wherein the large stepped hole receives a receptacle, the small stepped hole receives the joint of the lamp rod, and the receptacle receives the end portion of the joint; a positioning disk having a plurality of through holes and a plurality of locking holes, the through holes aligned with the stepped holes the locking holes disposed between the though holes, wherein the receptacle passes through one of the through holes; and a locking stud passes through a ground wire and passes through the locking hole to the seat to lock the positioning disk to a lower end of the seat with an edge of the receptacle resists against the positioning disk for preventing the receptacle from falling out; and the receptacle having a larger section and a smaller section, the larger section positioned in each of the large stepped holes of the seat; the smaller section protruded from a bottom of the positioning disk; and an outer threaded section formed on a bottom of the seat.

2. The do-it-yourself lamp as claimed in claim 1, wherein the seat has a plurality of threaded holes, each of the threaded holes corresponds to respective stepped holes, and a confining stud is inserted into the threaded hole to lock the joint.

3. The do-it-yourself lamp as claimed in claim 2, wherein a cap has a plurality of via holes corresponding to the stepped holes, and the cap positions on a top of the seat for covering the confining studs to prevent the confining studs from falling out of the seat.

4. The do-it-yourself lamp as claimed in claim 2, wherein the outer threaded section of the seat has a neck portion and the threaded hole on an annular surface of the neck portion corresponding to each of the small stepped hole, and the confining stub is inserted into the threaded hole for tightening the joint.

5. The do-it-yourself lamp as claimed in claim 1, wherein after the seat is assembled with the positioning disk, the receptacle and the ground wire, the outer threaded section of the seat is locked into a retaining tube of one of a wall lamp, stand lamp and a ceiling lamp.

6. A do-it-yourself lamp comprising a seat and a lamp rod arranged on the seat; a plurality of penetrated stepped holes formed in an interior of the seat; each of the stepped holes having a large stepped hole and a small stepped hole, one end portion of a joint protruded from a bottom end of the lamp rod, wherein the large stepped hole receives a receptacle, the small stepped hole receives the joint of the lamp rod, and the receptacle receives the end portion of the joint; a positioning disk having a plurality of though holes at a center of the positioning disk and at positions aligned to the stepped holes, wherein the receptacle passes through one of the though holes; and a locking stud passes through a ground wire and passes through a though hole, at the center of the positioning disk, to the seat to lock the positioning disk to a lower end of the seat with an edge of the receptacle resists against the positioning disk for preventing the receptacle from falling out; and the receptacle having a larger section and a smaller section; the larger section positioned in each of the large stepped holes of the seat; the smaller section protruded from a bottom of the positioning disk, and an outer threaded section formed on a bottom of the seat.

* * * * *